US009108818B2

(12) United States Patent
Kimura et al.

(10) Patent No.: US 9,108,818 B2
(45) Date of Patent: Aug. 18, 2015

(54) SHEET DISCHARGER AND IMAGE FORMING APPARATUS INCLUDING SAME

(75) Inventors: Ippei Kimura, Ikeda (JP); Yasuo Matsuyama, Itami (JP); Ikuo Fujii, Kawasaki (JP)

(73) Assignee: RICOH COMPANY, LTD., Tokyo (JP)

( * ) Notice: Subject to any disclaimer, the term of this patent is extended or adjusted under 35 U.S.C. 154(b) by 436 days.

(21) Appl. No.: 12/923,777

(22) Filed: Oct. 7, 2010

(65) Prior Publication Data

US 2011/0097126 A1 Apr. 28, 2011

(30) Foreign Application Priority Data

Oct. 27, 2009 (JP) ..... 2009-246466

(51) Int. Cl.
*G03G 15/00* (2006.01)
*B65H 29/12* (2006.01)
(Continued)

(52) U.S. Cl.
CPC ..... *B65H 29/125* (2013.01); *B65H 31/02* (2013.01); *B65H 31/20* (2013.01); *G03G 15/6552* (2013.01); *B65H 2402/443* (2013.01); *B65H 2404/1341* (2013.01); *B65H 2404/143* (2013.01); *B65H 2404/144* (2013.01); *B65H 2404/1521* (2013.01); *B65H 2405/1117* (2013.01); *B65H 2405/11151* (2013.01); *B65H 2405/11164* (2013.01); *B65H 2405/324* (2013.01); *B65H 2601/325* (2013.01); *B65H 2801/06* (2013.01); *B65H 2801/12* (2013.01)

(58) Field of Classification Search
CPC ..... B65H 29/125; B65H 31/02; B65H 31/20; B65H 2402/443; B65H 2402/1341; B65H 2402/143; B65H 2402/144; B65H 2402/1521; B65H 2405/11151; B65H 2405/11164; B65H 2405/1117; B65H 2405/324; G03G 15/6552
USPC ..... 399/405, 388; 271/281; 400/642, 646, 400/645.4, 645.3, 645.5
See application file for complete search history.

(56) References Cited

U.S. PATENT DOCUMENTS 5,132,742 A * 7/1992 Goto ..... 399/401
5,741,009 A * 4/1998 Kawano et al. ..... 271/182
6,089,567 A * 7/2000 Yatsuhashi et al. ..... 271/314
(Continued)

FOREIGN PATENT DOCUMENTS

JP 03161371 A * 7/1991
JP 05-188680 A 7/1993
(Continued)

OTHER PUBLICATIONS

English language abstract for JP-09-278256 published on Oct. 28, 1997 which corresponds to JP-3484293-A.

*Primary Examiner* — Matthew G Marini
(74) *Attorney, Agent, or Firm* — Harness, Dickey & Pierce, P.L.C.

(57) ABSTRACT

A sheet discharger including a pair of rotary bodies to discharge a sheet to a discharge part by rotating while sandwiching the sheet and to hold the sheet, a part of which is discharged and exposed from a discharge exit of the sheet discharger, and a separation unit operatively connected to the pair of rotary bodies, including an operating part provided closer to the discharge exit than the pair of rotary bodies to support the sheet held by the pair of rotary bodies, that separates the pair of rotary bodies from each other by withdrawal of the sheet held by the pair of rotary bodies toward the discharge exit of the sheet discharger.

14 Claims, 7 Drawing Sheets

(51) Int. Cl.
*B65H 31/02* (2006.01)
*B65H 31/20* (2006.01)

(56) References Cited

U.S. PATENT DOCUMENTS 6,270,071 B1 * 8/2001 Asada ..... 271/119
7,532,855 B2 * 5/2009 Kajita ..... 399/406
7,669,849 B2 * 3/2010 Liu et al. ..... 271/272
2006/0165455 A1 * 7/2006 Kajita ..... 399/406

FOREIGN PATENT DOCUMENTS

JP 07-157174 A 6/1995
JP 08-073102 A 3/1996
JP 3484293 A 10/2003

* cited by examiner

SHEET DISCHARGER AND IMAGE FORMING APPARATUS INCLUDING SAME

PRIORITY STATEMENT

The present patent application claims priority from Japanese Patent Application No. 2009-246466, filed on Oct. 27, 2009, in the Japan Patent Office, which is hereby incorporated herein by reference in its entirety.

BACKGROUND

1. Technical Field

Illustrative embodiments described in this patent specification generally relate to a sheet discharger and an image forming apparatus including the sheet discharger.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus by a sheet discharger.

Related-art sheet dischargers often employ a catch system, in which a rear edge of a sheet being discharged from the image forming apparatus is sandwiched by a pair of discharge rollers to hold the sheet while the rest of the sheet hangs exposed from the image forming apparatus.

In such sheet dischargers, the sheet thus sandwiched by the pair of discharge rollers is pulled by a user to be discharged from the image forming apparatus. At this time, the discharge rollers, which are in a stopped state to sandwich the sheet, are rotated by the pulling of the sheet. However, because the pair of discharge rollers is connected to a driving unit such as a motor, a load torque is generated by rotating the pair of discharge rollers in this stopped state. Consequently, a certain amount of force is required for the user to pull the sheet out of the image forming apparatus, causing inconvenience to the user to discharge the sheet from the image forming apparatus.

In addition, the sheet pulled by the user scrapes against the pair of discharge rollers, possibly causing toner or dust attached to the pair of discharge rollers to be further attached to the sheet. Further, an image formed near the rear edge of the sheet may be damaged by such scraping against the pair of discharge rollers.

A lever is sometimes provided to separate the pair of discharge rollers from each other to release the sheet when the sheet is pulled out of the image forming apparatus, thereby solving the above-described problems and inconvenience. However, because the user must operate the lever before pulling the sheet out of the image forming apparatus, an additional operation is imposed on the user to discharge the sheet from the image forming apparatus.

SUMMARY

In view of the foregoing, illustrative embodiments described herein provide a sheet discharger from which a sheet to be discharged therefrom is easily pulled out by a user, and an image forming apparatus including the sheet discharger.

At least one embodiment provides a sheet discharger including a pair of rotary bodies to discharge a sheet to a discharge part by rotating while sandwiching the sheet and to hold the sheet, a part of which is discharged and exposed from a discharge exit of the sheet discharger, and a separation unit operatively connected to the pair of rotary bodies, including an operating part provided closer to the discharge exit than the pair of rotary bodies to support the sheet held by the pair of rotary bodies, that separates the pair of rotary bodies from each other by withdrawal of the sheet held by the pair of rotary bodies toward the discharge exit of the sheet discharger.

At least one embodiment provides an image forming apparatus including the sheet discharger described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
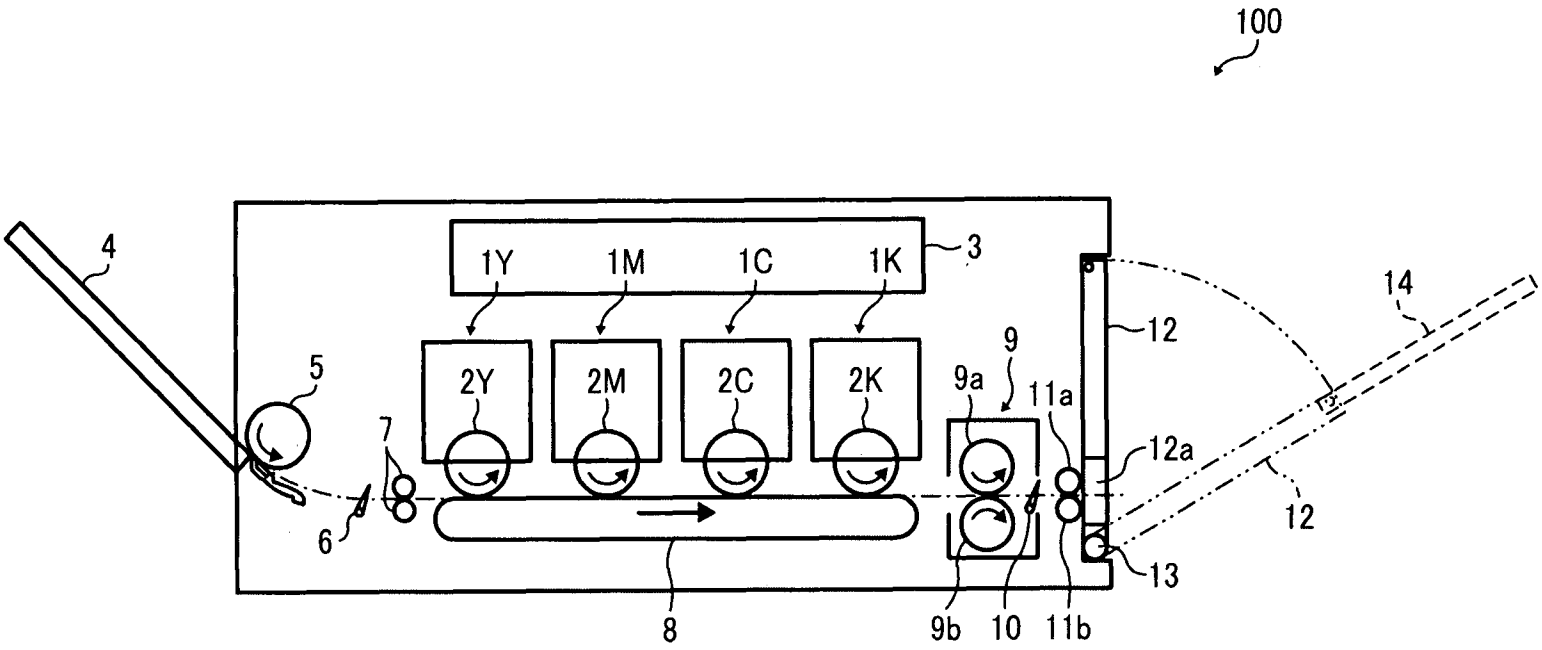
FIG. 1 is a vertical cross-sectional view illustrating a configuration of an image forming apparatus including a sheet discharger according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings, wherein like reference, numerals designate identical or corresponding parts throughout the several views.

FIG. 1 is a vertical cross-sectional view illustrating a configuration of a full-color image forming apparatus 100 including a sheet discharger according to illustrative embodiments. The image forming apparatus 100 includes four image forming units 1Y, 1M, 1C, and 1K (hereinafter collectively referred to as image forming units 1), each forming an image of a specific color, that is, yellow (Y), magenta (M), cyan (C), or black (K), respectively. Each of the image forming units 1 has the same basic configuration, differing only in the color of toner used. Specifically, the image forming units 1 respectively include photoconductors 2Y, 2M, 2C, and 2K (hereinafter collectively referred to as photoconductors 2) each serving as an image carrier to carry a toner image of the specific color on a surface thereof, chargers, developing devices, cleaning devices, neutralizing devices, and so forth.

An irradiating device 3 that directs light onto the surface of each of the photoconductors 2 is provided above the image forming units 1. The image forming apparatus 100 further includes, in order from the left to the right in FIG. 1, a sheet feed tray 4 on which multiple sheets of paper can be placed, a sheet feed roller 5 that feeds the sheets one by one from the sheet feed tray 4, a registration sensor 6 and a pair of registration rollers 7 each controlling a timing to feed the sheet, a conveyance belt 8 serving as a conveyance unit to convey the sheet, a fixing device 9 that fixes the toner image onto the sheet, a discharge sensor 10 that detects completion of discharge of the sheet out of the image forming apparatus 100, a sheet discharger 15, not shown in FIG. 1, including a pair of discharge rollers 11*a* and 11*b*, and a discharge tray 12 that stacks the sheet discharged from the image forming apparatus 100.

It is to be noted that the sheets of paper herein refer to media onto which images can be transferred to form the images thereon. Examples of the media include, but are not limited to, a transfer sheet or a recording sheet such as a cardboard, a postcard, an envelope, plain paper, or thin paper; enamel paper such as coated paper or art paper; an OHP sheet or an OHP film; and tracing paper.

The fixing device 9 includes a fixing roller 9*a* having a heat source therein, and a pressing roller 9*b* pressed against the fixing roller 9*a* to form a fixing nip therebetween.

The discharge tray 12 is hingedly supported to be rotated around a rotary shaft 13 provided in a main body of the image forming apparatus 100. When the discharge tray 12 is opened from the main body of the image forming apparatus 100 as indicated by dotted lines in FIG. 1, the sheet discharged from the image forming apparatus 100 is stacked on an upper surface of the discharge tray 12. By contrast, when closed, the discharge tray 12 is flush with the exterior of the image forming apparatus 100. The discharge tray 12 has an extendable tray 14 that can be pulled out and extended from the discharge tray 12 to accept a large-sized sheet thereon. Further, a discharge opening 12*a* through which the sheet can be discharged while the discharge tray 12 is closed is provided to the discharge tray 12 opposite the pair of discharge rollers 11*a* and 11*b*.

A description is now given of the basic operation of the image forming apparatus 100 with reference to FIG. 1.

At the start of image formation, first, the photoconductors 2 of the image forming units 1 are rotated in a counterclockwise direction in FIG. 1, respectively. Next, the chargers evenly charge the surfaces of the photoconductors 2 to a predetermined polarity. The irradiating device 3 directs laser light onto the charged surfaces of the photoconductors 2 based on image data of each color to form electrostatic latent images of the specific color on the surfaces of the photoconductors 2, respectively. It is to be noted that the image data written on each of the surfaces of the photoconductors 2 is single-color image data obtained by separating image data of a full-color image to be formed into image data of the specific color, that is, yellow, magenta, cyan, or black. Thereafter, toner of the specific color is supplied from the developing devices to the electrostatic latent images formed on the surfaces of the photoconductors 2 to form toner images of the specific color on the surfaces of the photoconductors 2.

Concurrently with the above-described operation, the sheet feed roller 5 is rotated by a motor, not shown, in a counterclockwise direction in FIG. 1 to feed a sheet P from the sheet feed tray 4. Rotation of the sheet feed roller 5 is stopped a certain period of time after the sheet P thus fed passes through the registration sensor 6, so that conveyance of the sheet P is temporarily stopped while a leading edge of the sheet P contacts the pair of registration rollers 7. The pair of registration rollers 7 is rotated in synchronization with the yellow toner image formed on the surface of the photoconductor 2Y to feed the sheet to the conveyance belt 8. Accordingly, the yellow toner image is transferred from the surface of the photoconductor 2Y onto the sheet P conveyed on the conveyance belt 8 at a transfer position formed between the photoconductor 2Y and the conveyance belt 8.

Thereafter, the magenta toner image, the cyan toner image, and the black toner images are sequentially transferred and superimposed one atop the other on the yellow toner image on the sheet P when the sheet P passes through transfer positions formed between the conveyance belt 8 and each of the photoconductors 2M, 2C, and 2K. As a result, a full-color toner image is formed on the sheet P. After the toner images of the specific color are transferred onto the sheet, residual toner remaining on the surfaces of the photoconductors 2 is removed by the cleaning devices, respectively. Subsequently, the surfaces of the photoconductors 2 are neutralized to initialize a polarity thereon by the neutralizing devices to be ready for the next sequence of image formation.

The sheet P having the full-color toner image thereon is then conveyed to the fixing device 9, and heat and pressure are applied to the sheet P by the fixing roller 9*a* and the pressing roller 9*b* to fix the full-color toner image on the sheet P. The sheet P having the fixed full-color image thereon is then discharged by the pair of discharge rollers 11*a* and 11*b* onto the discharge tray 12 when the discharge tray 12 is opened from the main body of the image forming apparatus 100. It is to be noted that whether or not the discharge tray 12 is opened from the main body of the image forming apparatus 100 is detected by a detector, not shown.

Figure 2:
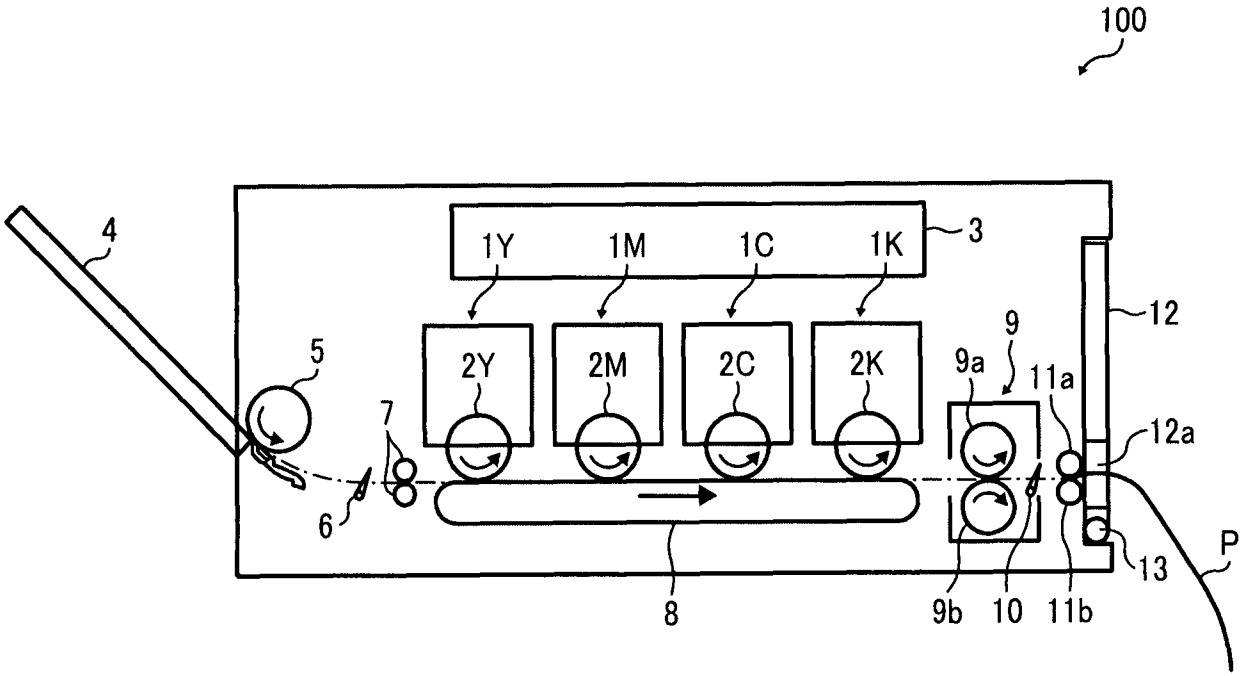
FIG. 2 is a vertical cross-sectional view illustrating the image forming apparatus illustrated in FIG. 1 in which a sheet being discharged from the image forming apparatus, a part of which is exposed from the image forming apparatus, is sandwiched and held by a pair of discharge rollers.

By contrast, when the discharge tray 12 is closed, rotation of the pair of discharge rollers 11*a* and 11*b* is stopped a predetermined period of time after the discharge sensor 10 detects the sheet P. Specifically, rotation of the pair of discharge rollers 11*a* and 11*b* is stopped while a rear edge of the sheet P is sandwiched by the pair of discharge rollers 11*a* and 11*b*. Accordingly, the sheet P is held by the pair of discharge rollers 11*a* and 11*b* while the rest of the sheet P is discharged from the discharge opening 12*a* of the discharge tray 12 and is exposed from the image forming apparatus 100 as illustrated in FIG. 2. In a case in which the image forming apparatus 100 does not include the discharge sensor 10, for example, a period of time required for the rear edge of the sheet P fed from the sheet feed tray 4 by the sheet feed roller 5 to reach the pair of discharge rollers 11*a* and 11*b* is set in advance so that rotation of the pair of discharge rollers 11*a* and 11*b* is controlled to be stopped while sandwiching the rear edge of the sheet P. Accordingly, the pair of discharge rollers 11*a* and 11*b* can hold the sheet P as described above, thereby preventing the sheet P being discharged from the image forming apparatus 100 from dropping from the image forming apparatus 100.

When images are formed on multiple sheets P, a subsequent sheet P is not fed until the previous sheet P sandwiched by the pair of discharge rollers 11*a* and 11*b* is pulled out and removed by a user. When the discharge sensor 10 detects removal of the previous sheet P from the pair of discharge rollers 11*a* and 11*b*, the subsequent sheet P is then fed from the sheet feed tray 4 by the sheet feed roller 5 to restart image formation. Alternatively, after the previous sheet P is removed from the pair of discharge rollers 11*a* and 11*b* by the user, the user may press a switch, not shown, provided to the image forming apparatus 100 to restart feeding of and image formation for the subsequent sheet P.

Figure 3:
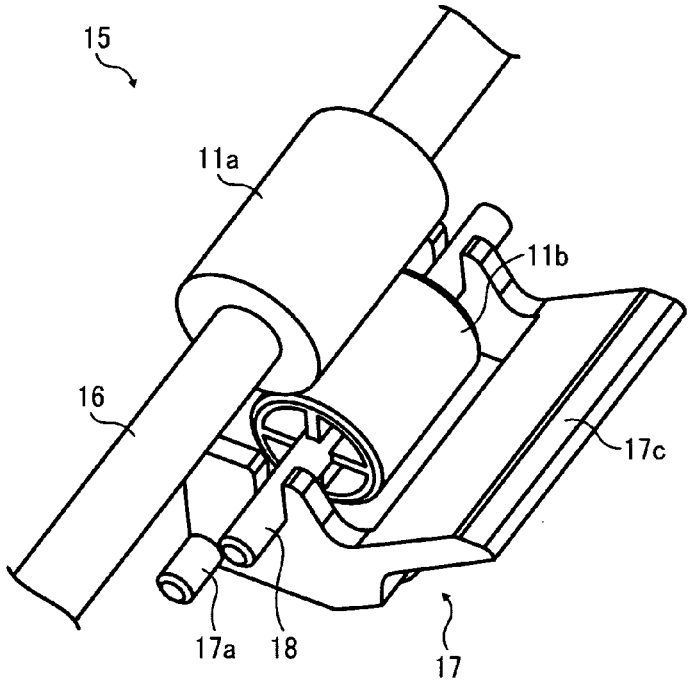
FIG. 3 is a perspective view illustrating main components of a sheet discharger according to a first illustrative embodiment.
Figure 4A:
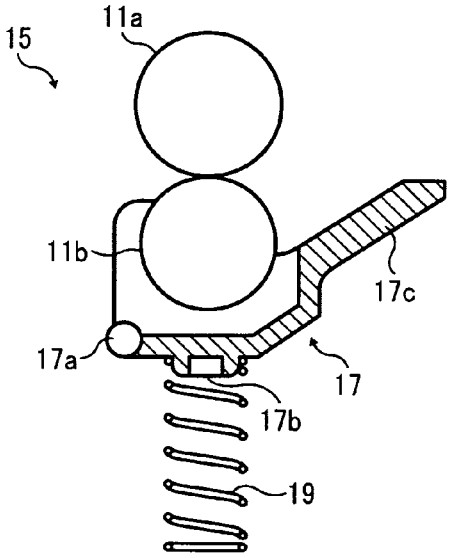
FIG. 4A is a vertical cross-sectional view illustrating a pair of discharge rollers contacting each other.
Figure 4B:
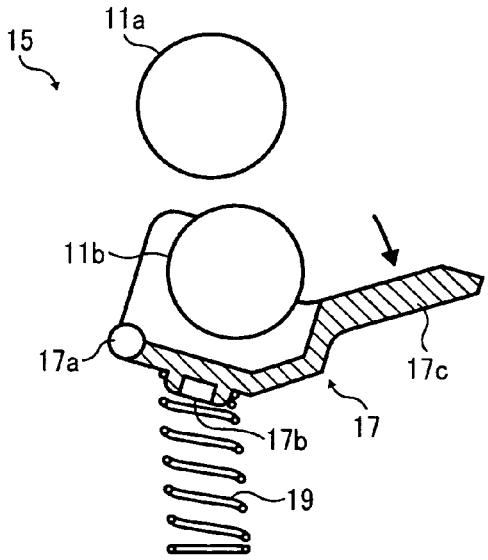
FIG. 4B is a vertical cross-sectional view illustrating the pair of discharge rollers separating from each other.

A description is now given of the sheet discharger 15 according to a first illustrative embodiment. FIG. 3 is a perspective view illustrating main components of the sheet discharger 15 according to the first illustrative embodiment. FIGS. 4A and 4B are vertical cross-sectional views respectively illustrating the main components of the sheet discharger 15 illustrated in FIG. 3.

The sheet discharger 15 includes the pair of discharge rollers 11*a* and 11*b* serving as rotary bodies disposed opposite each other. The discharge roller 11*a* is positioned above the discharge roller 11*b*, and is hereinafter also referred to as an upper discharge roller 11*a* for ease of description. For the same reason, the discharge roller 11*b* positioned below the upper discharge roller 11*a* is hereinafter also referred to as a lower discharge roller 11*b*.

The upper discharge roller 11*a* is formed of a material having a higher surface frictional factor such as rubber, and is connected to a motor, not shown, via a rotary shaft 16. The lower discharge roller 11*b* is formed of a resin or the like, and is rotatably held by a holding member 17. The holding member 17 is rotatable around a rotary shaft 17*a* provided parallel to a rotary shaft 18 of the lower discharge roller 11*b*. The rotary shaft 17*a* is held and positioned by a bearing or the like, not shown. An end of a compression coil spring 19 serving as a biasing member is fixed to a protrusion 17*b* provided on a lower surface of the holding member 17 so that the holding member 17 is pushed upward by a biasing force of the compression coil spring 19. It is to be noted that, alternatively, another biasing member such as a tension coil spring or a torsion coil spring may be used to push the holding member 17 upward in place of the compression coil spring 19. The holding member 17 further has an operating part 17*c* provided closer to a discharge exit of the sheet P, that is, to the right in FIGS. 1 and 2, than the pair of discharge rollers 11*a* and 11*b*.

The lower discharge roller 11*b* is pressed against the upper discharge roller 11*a* by the holding member 17 pushed upward by the compression coil spring 19 as illustrated in FIG. 4A. By contrast, when the holding member 17 is rotated in a clockwise direction against the biasing force of the compression coil spring 19 as illustrated in FIG. 4B by a force applied to the operating part 17*c*, the lower discharge roller 11*b* is separated from the upper discharge roller 11*a*. In other words, the holding member 17 rotates to function as a separation unit that separates the pair of discharge rollers 11*a* and 11*b* from each other.

Figure 5:
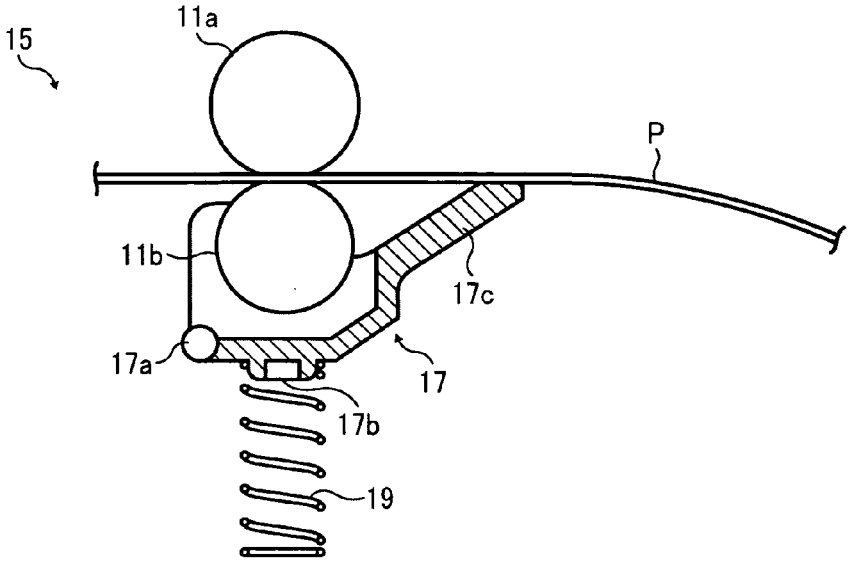
FIG. 5 is a vertical cross-sectional view illustrating a state in which a rear edge of a sheet is sandwiched by the pair of discharge rollers.
Figure 6:
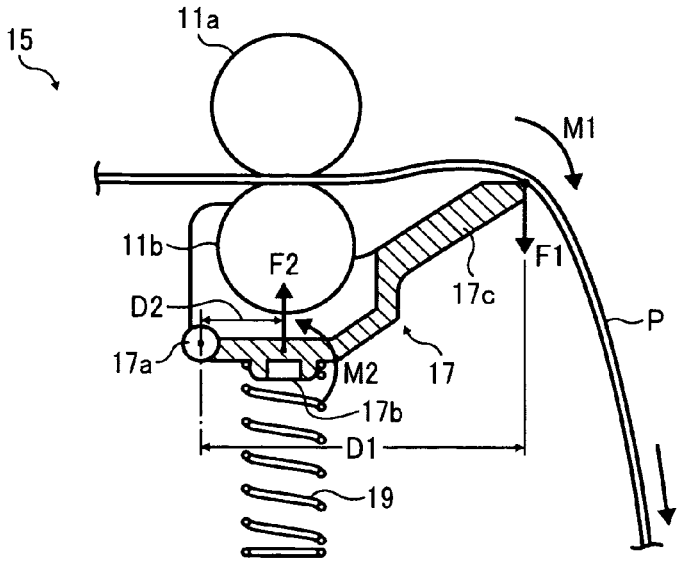
FIG. 6 is a vertical cross-sectional view illustrating a state in which the sheet sandwiched by the pair of discharge rollers is pulled downward.
Figure 7:
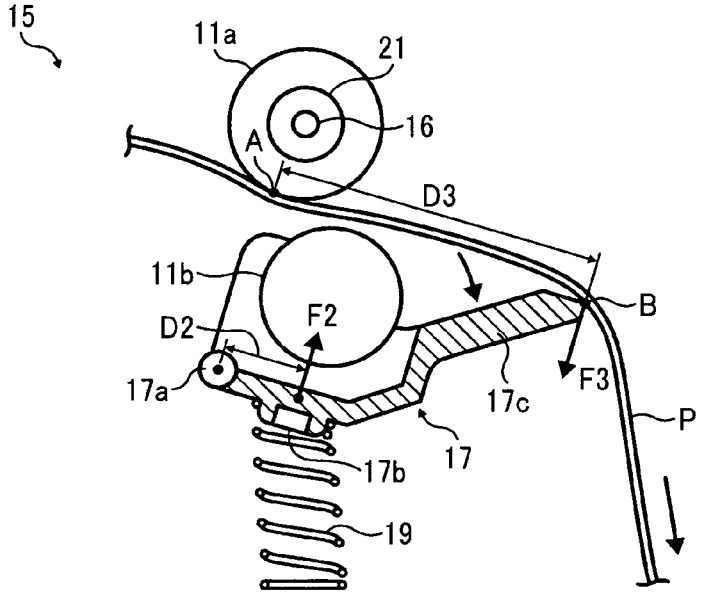
FIG. 7 is a vertical cross-sectional view illustrating a state in which the pair of discharge rollers is separated from each other by pulling the sheet downward.

A description is now given of discharge of the sheet P from the sheet discharger 15 with reference to FIGS. 5 to 7. FIG. 5 is vertical cross-sectional view illustrating a state in which the rear edge of the sheet P is sandwiched by the pair of discharge rollers 11*a* and 11*b*. FIG. 6 is a vertical cross-sectional view illustrating a state in which the sheet P sandwiched by the pair of discharge rollers 11*a* and 11*b* is pulled downward. FIG. 7 is a vertical cross-sectional view illustrating a state in which the pair of discharge rollers 11*a* and 11*b* is separated from each other by pulling the sheet P downward. It is to be noted that although the sheet P is assumed to be cardboard having higher flexibility with a weight of not less than 100 g/m$^2$ in the first illustrative embodiment, the sheet P applicable to the first illustrative embodiment is not limited thereto.

In order to discharge the sheet P from the sheet discharger 15, first, a part of the sheet P discharged and exposed from the image forming apparatus 100 in the right in FIG. 6 is pulled downward. At this time, the sheet P contacts a tip portion of the operating part 17*c* provided to the holding member 17, so that a force F1 that presses the operating part 17*c* downward acts on the tip portion of the operating part 17*c*, as shown in FIG. 6. Further, a force F2 that pushes the holding member 17 upward acts on the holding member 17 by the compression coil spring 19. Accordingly, a torque M1 and a torque M2 are generated at the holding member 17 by the forces F1 and F2, respectively. The amount of the torque M1 is obtained by multiplying the amount of the force F1 by a distance D1 from the rotary shaft 17*a* to a line of action of the force F1 (M1=F1×D1), and the amount of the torque M2 is obtained by multiplying the amount of the force F2 by a distance D2 from the rotary shaft 17*a* to a line of action of the force F2 (M2=F2×D2). The sheet P is pulled downward such that the amount of the torque M1 exceeds the amount of the torque M2. As a result, the holding member 17 is rotated around the rotary shaft 17*a* in a clockwise direction as illustrated in FIG. 7.

As the holding member 17 rotates around the rotary shaft 17*a* in a clockwise direction as illustrated in FIG. 7, the lower discharge roller 11*b* is separated from the upper discharge roller 11*a*. Accordingly, the sheet P is released from the upper and lower discharge rollers 11*a* and 11*b*. When the upper and lower discharge rollers 11*a* and 11*b* are separated from each other, a distance D3 from a contact point A where the sheet P and the upper discharge roller 11*a* contact each other to a contact point B where the sheet P and the operating part 17*c* of the holding member 17 contact each other is set to a short distance, for example, in a range between 5 mm and 20 mm. Accordingly, the sheet P tends not to be bent at the contact points A and B. As a result, the sheet P presses the operating part 17*c* downward using the contact point A as a fulcrum and the contact point B as a point of action so that the lower discharge roller 11*b* remains separated from the upper discharge roller 11*a*.

As described above, the upper and lower discharge rollers 11*a* and 11*b* remain separated from each other when the sheet P is removed therefrom. In other words, the sheet P is pulled and discharged from the sheet discharger 15 while being released from the upper and lower discharge rollers 11*a* and 11*b*. As a result, a force required for the user to pull the sheet P out of the image forming apparatus 100 can be reduced, thereby facilitating discharge of the sheet P from the image forming apparatus 100.

In the state illustrated in FIG. 6, the amount of the force F1 that presses the tip portion of the operating part 17*c* downward in order to rotate the holding member 17 in a clockwise direction varies depending on a ratio between the distance D1 and the distance D2. In the first illustrative embodiment, the distance D2 is substantially set to the one-third of the distance D1. Accordingly, the holding member 17 is rotated in a clockwise direction in FIG. 7 with the force F1, the amount of which is about the one-third of the amount of force F2 of the compression coil spring 19.

In the state illustrated in FIG. 7, an amount of a force F3 that presses the tip portion of the operating part 17*c* downward in order to keep the holding member 17 rotated varies depending on a ratio between the distance D2 and a distance D3 from the contact point A to a line of action of the force F3 acting on the contact point B, that is, the tip portion of the operating part 17*c*. In the first illustrative embodiment, the distance D2 is substantially set to the one-third of the distance D3. Accordingly, the holding member 17 remains rotated with the force F3, the amount of which is about the one-third of the amount of force F2 of the compression coil spring 19.

In other words, relative positions of the rotary shaft 17*a*, the compression coil spring 19, and the operating part 17*c* are adjusted to change the amount of force required to press the operating part 17*c* downward. As a result, the operating part 17*c* can be pressed downward with a smaller amount of force against the amount of force of the compression coil spring 19 that pushes the holding member 17 upward, thereby reducing the amount of force required for the user to pull the sheet P out of the image forming apparatus 100.

When being pulled out of the image forming apparatus 100, the sheet P remains in contact with the upper discharge roller 11*a* in a stopped state. As a result, friction is generated between the sheet P and the upper discharge roller 11*a*. Even when the upper discharge roller 11*a* is rotated by pulling the sheet P downward, a load torque against the direction of rotation of the upper discharge roller 11*a* is generated because the upper discharge roller 11*a* is connected to the motor. In order to reduce generation of the load torque, a one-way clutch 21 is provided to a transmission system that transmits a drive force to the upper discharge roller 11*a*. Accordingly, even when driving of the upper discharge roller 11*a* is stopped, the upper discharge roller 11*a* can be idly rotated as the sheet P is pulled out of the image forming apparatus 100. As a result, resistance caused by friction or load torque generated upon removal of the sheet P from the sheet discharger 15 can be considerably reduced, and the sheet P can be pulled out of the image forming apparatus 100 with a further reduced amount of force.

Figure 8A:
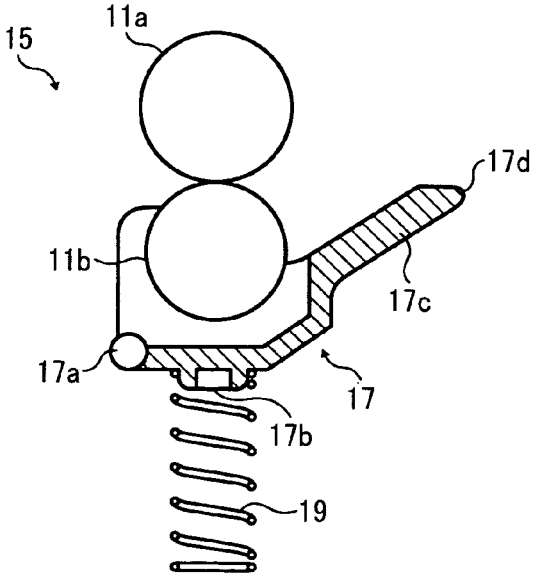
FIG. 8A is a vertical cross-sectional view illustrating main components of a sheet discharger according to a second illustrative embodiment.

A description is now given of a second illustrative embodiment of the present disclosure. FIG. 8A is a vertical cross-sectional view illustrating the main components of the sheet discharger 15 according to the second illustrative embodiment. FIG. 83 is an enlarged vertical cross-sectional view illustrating the main components of the sheet discharger 15 illustrated in FIG. 8A.

Figure 8B:
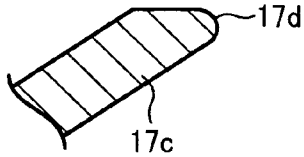
FIG. 8B is an enlarged vertical cross-sectional view illustrating the main components of the sheet discharger illustrated in FIG. 8A.

As illustrated in FIGS. 8A and 8B, in the sheet discharger 15 according to the second illustrative embodiment a surface 17*d* at the tip of the operating part 17*c* of the holding member 17 is curved. The rest of the configuration of the sheet discharger 15 according to the second illustrative embodiment is the same as that of the sheet discharger 15 according to the first illustrative embodiment, and descriptions thereof are omitted.

Figure 9:
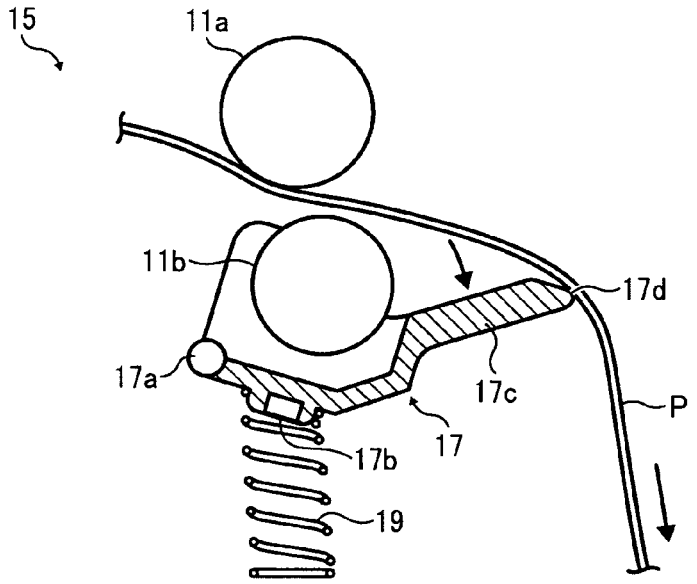
FIG. 9 is a vertical cross-sectional view illustrating a state in which a pair of discharge rollers illustrated in FIG. 8A is separated from each other by pulling the sheet downward.

FIG. 9 is a vertical cross-sectional view illustrating a state in which the upper and lower discharge rollers 11*a* and 11*b* are separated from each other by pulling the sheet P downward. When the sheet P contacts the surface 17*d* of the operating part 17*c* in order to press the operating part 17*c* downward, the curved surface 17*d* can reduce sliding resistance between the sheet P and the surface 17*d*. Accordingly, damage to the sheet P caused by the surface 17*d* contacting the sheet P can be reduced, as can a force required for the user to pull the sheet P out of the image forming apparatus 100.

Alternatively, at least a surface of the operating part 17*c* that contacts the sheet P may be formed of a material having a reduced frictional factor such as a fluorocarbon resin to reduce sliding resistance between the sheet P and the operating part 17*c*, thereby reducing damage to the sheet P as well as a force required to pull the sheet P out of the image forming apparatus 100.

Figure 10:
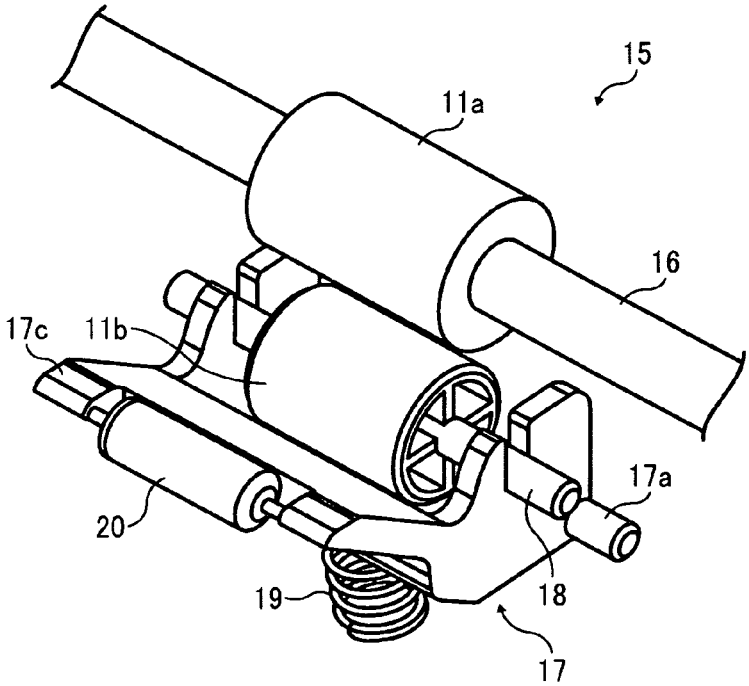
FIG. 10 is a perspective view illustrating main components of a sheet discharger according to a third illustrative embodiment.

A description is now given of a third illustrative embodiment of the present disclosure. FIG. 10 is a perspective view illustrating the main components of the sheet discharger 15 according to the third illustrative embodiment. It is to be noted that the sheet P is discharged from the upper and lower discharge rollers 11*a* and 11*b* to the lower left in FIG. 10.

A roller member 20 is rotatably provided to the tip portion of the operating part 17*c* in the sheet discharger 15 according to the third illustrative embodiment. The rest of the configuration of the sheet discharger 15 according to the third illustrative embodiment is the same as that of the sheet discharger 15 according to the first illustrative embodiment, and descriptions thereof are omitted.

Figure 11:
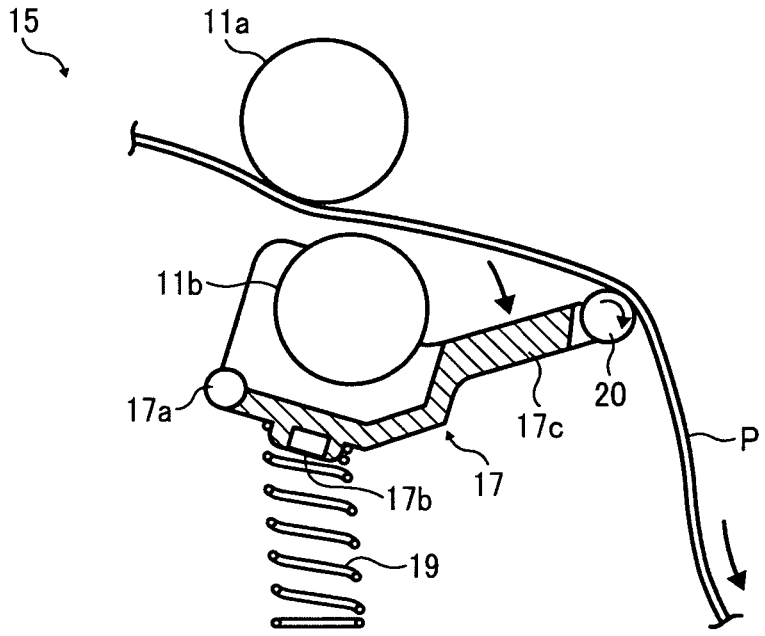
FIG. 11 is a vertical cross-sectional view illustrating a state in which a pair of discharge rollers illustrated in FIG. 10 is separated from each other by pulling the sheet downward.

FIG. 11 is a vertical cross-sectional view illustrating a state in which the upper and lower discharge rollers 11*a* and 11*b* are separated from each other by pulling the sheet P downward. When the user pulls the sheet P out of the image forming apparatus 100, the sheet P contacts the roller member 20, pressing the operating part 17*c* downward. At this time, the roller member 20 is rotated as the sheet P is pulled and moved, thereby reducing resistance generated between the roller member 20 and the sheet P upon removal of the sheet P. As a result, damage to the sheet P caused by the operating part 17*c* contacting the sheet P can be reduced as well as a force required for the user to pull the sheet P out of the image forming apparatus 100 is reduced.

As described above, the sheet P can be easily pulled out of the image forming apparatus 100 while the upper and lower discharge rollers 11*a* and 11*b* remain separated from each other according to the foregoing illustrative embodiments. As a result, a force required for the user to pull the sheet P out of the image forming apparatus 100 can be reduced, and attachment of foreign substances such as toner or dust adhering to the upper and lower discharge rollers 11*a* and 11*b* to the sheet P can be prevented. Further, deterioration of the image formed near the rear edge of the sheet P can be prevented upon discharge of the sheet P from the image forming apparatus 100.

In addition, the upper and lower discharge rollers 11*a* and 11*b* can be easily separated from each other by simply pulling downward the sheet P sandwiched by the upper and lower discharge rollers 11*a* and 11*b*, and the sheet P can be pulled out of the image forming apparatus 100 while being released from the upper and lower discharge rollers 11*a* and 11*b*. In other words, a lever or the like that separates the upper and lower discharge rollers 11*a* and 11*b* from each other is not needed in the sheet discharger 15 according to the foregoing illustrative embodiments, thereby simplifying the configuration of the sheet discharger 15. Further, the user does not need to operate the lever or the like to pull the sheet P out of the image forming apparatus 100, thereby providing a user-friendly configuration.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

For example, although the lower discharge roller 11*b* is separated from the upper discharge roller 11*a* by rotating the holding member 17 according to the foregoing illustrative embodiments, alternatively, the upper discharge roller 11*a* may be separated from the lower discharge roller 11*b*. Further, although being formed of a resin or the like according to the foregoing illustrative embodiments, alternatively, the lower discharge roller 11*b* may be formed of a material having a higher surface frictional factor such as rubber in the similar way as the upper discharge roller 11*a* to achieve the same effects as the foregoing illustrative embodiments.

The sheet discharger 15 according to the foregoing illustrative embodiments is applicable not only to the full-color image forming apparatus 100 but also to a monochrome image forming apparatus, a copier, a printer, a facsimile machine, or a multifunction device having two or more of copying, printing, and facsimile functions.

What is claimed is:

1. A sheet discharger, comprising: a pair of rotary bodies to discharge a sheet to a discharge part by rotating while sandwiching the sheet and to hold the sheet, a part of which is discharged and exposed from a discharge exit of the sheet discharger; and a separation unit operatively connected to the pair of rotary bodies, the separation unit having parallel side walls including slots that hold therein a shaft of at least one of the pair of rotary bodies and formed on each side of at least one of the pair of rotating bodies, a fixed front wall, between the side walls that structurally fixes the two side walls of the separation unit to one another and extends from a surface of the separation unit and encloses at least one of the rotary bodies in a sheet discharge direction and includes a sheet contact point on a tip portion thereof, the front wall being an operating part, wherein the operating part is provided closer to the discharge exit than the pair of rotary bodies to support the sheet held by the pair of rotary bodies and separates the pair of rotary bodies from each other by withdrawal of the sheet held by the pair of rotary bodies toward the discharge exit of the sheet discharger, wherein the front wall is a vertically oriented wall downstream of the at least one rotary body enclosed in the separation unit and the operating part extends from the front wall in a direction downstream of the pair of rotary bodies.

2. The sheet discharger according to claim 1, wherein at least a surface of the operating part configured to contact the sheet is curved.

3. The sheet discharger according to claim 1, wherein at least a surface of the operating part configured to contact the sheet is formed of a material having a lower frictional factor.

4. The sheet discharger according to claim 1, wherein the operating part comprises a rotatable roller member between the side walls and downstream of the pair of rotary bodies in the sheet discharge direction.

5. The sheet discharger according to claim 1, wherein the separation unit further comprises a holding member incorporating the operating part and rotatable around a rotary shaft provided parallel to a rotary shaft of one of the pair of rotary bodies to hold the one of the pair of rotary bodies.

6. The sheet discharger according to claim 5, wherein the other, non-supported rotary body of the pair of rotary bodies comprises a one-way clutch to allow the rotary body to rotate freely as the sheet is pulled and moved.

7. The sheet discharger according to claim 5, further comprising a biasing member to push the holding member to press the one of the pair of rotary bodies against the other of the pair of rotary bodies.

8. The sheet discharger according to claim 1, wherein the pair of rotating bodies includes an upper discharge roller and a lower discharge roller, and the operating part is downstream of the pair of rotary bodies in the sheet discharge direction and has a width greater than a width of the upper discharge roller.

9. The sheet discharger according to claim 1, wherein the tip portion is downwardly rotatable away from at least one of the pair of rotary bodies.

10. The sheet discharger according to claim 1, wherein the operating part extends from a flat planar surface of the separation unit and includes a beveled edge.

11. An image forming apparatus comprising a sheet discharger, the sheet discharger comprising:

a pair of rotary bodies to discharge a sheet to a discharge part by rotating while sandwiching the sheet and to hold the sheet, a part of which is discharged and exposed from a discharge exit of the sheet discharger; and a separation unit operatively connected to the pair of rotary bodies, the separation unit having parallel side walls including slots that hold therein a shaft of at least one of the pair of rotary bodies and formed on each side of at least one of the pair of rotating bodies, a fixed front wall between the side walls that structurally fixes the two side walls of the separation unit to one another and extends from a surface of the separation unit and encloses at least one of the rotary bodies in a sheet discharge direction and includes a sheet contact point on a tip portion thereof, the front wall being an operating part, wherein the operating part is provided closer to the discharge exit than the pair of rotary bodies to support the sheet held by the pair of rotary bodies and separates the pair of rotary bodies from each other by withdrawal of the sheet held by the pair of rotary bodies toward the discharge exit of the sheet discharger wherein the front wall is a vertically oriented wall downstream of the at least one rotary body enclosed in the separation unit and the operating part extends from the front wall in a direction downstream of the pair of rotary bodies.

12. The image forming apparatus according to claim 11, wherein the pair of rotating bodies includes an upper discharge roller and a lower discharge roller, and the operating part is downstream of the pair of rotary bodies in the sheet discharge direction and has a width greater than a width of the upper discharge roller.

13. The image forming apparatus according to claim 11, wherein the tip portion is downwardly rotatable away from at least one of the pair of rotary bodies.

14. The image forming apparatus according to claim 11, wherein the operating part extends from a flat planar surface of the separation unit and includes a beveled edge.

* * * * *